US010767933B2

(12) United States Patent
Romlund

(10) Patent No.: US 10,767,933 B2
(45) Date of Patent: Sep. 8, 2020

(54) HEAT EXCHANGER PLATE FOR A PLATE HEAT EXCHANGER, AND A PLATE HEAT EXCHANGER

(71) Applicant: ALFA LAVAL CORPORATE AB, Lund (SE)

(72) Inventor: Jens Romlund, Helsingborg (SE)

(73) Assignee: ALFA LAVAL CORPORATE AB, Lund (SE)

( * ) Notice: Subject to any disclaimer, the term of this patent is extended or adjusted under 35 U.S.C. 154(b) by 238 days.

(21) Appl. No.: 16/071,003

(22) PCT Filed: Jan. 27, 2017

(86) PCT No.: PCT/EP2017/051715
§ 371 (c)(1),
(2) Date: Jul. 18, 2018

(87) PCT Pub. No.: WO2017/144230
PCT Pub. Date: Aug. 31, 2017

(65) Prior Publication Data

US 2019/0024983 A1 Jan. 24, 2019

(30) Foreign Application Priority Data

Feb. 24, 2016 (SE) ..... 1650241

(51) Int. Cl.
*F28D 9/00* (2006.01)
*F28F 3/02* (2006.01)
(Continued)

(52) U.S. Cl.
CPC ..... *F28D 9/0062* (2013.01); *F28D 9/0081* (2013.01); *F28F 3/025* (2013.01);
(Continued)

(58) Field of Classification Search
CPC ..... F28D 9/0062; F28D 9/0018; F28F 3/025; F28F 3/046; F28F 3/08; F28F 13/14
See application file for complete search history.

(56) References Cited

U.S. PATENT DOCUMENTS 2,777,674 A 1/1957 Wakeman
5,203,832 A 4/1993 Beatenbough et al.
(Continued)

FOREIGN PATENT DOCUMENTS

CN 202942655 U 5/2013
CN 203443451 U 2/2014
(Continued)

OTHER PUBLICATIONS

International Search Report (PCT/ISA/210) dated Apr. 19, 2017, by the European Patent Office as the International Searching Authority for International Application No. PCT/EP2017/051715.
(Continued)

*Primary Examiner* — Devon Russell
(74) *Attorney, Agent, or Firm* — Buchanan Ingersoll & Rooney PC

(57) ABSTRACT

A plate heat exchanger, and a heat exchanger plate for the plate heat exchanger for heat exchange between a first fluid and a second fluid are disclosed. The heat exchanger plate comprises a heat exchanger area comprising a first end zone, a central main zone adjoining the first end zone, a second end zone adjoining the central main zone, and a corrugation of ridges and valleys on the heat exchanger area. A longitudinal center axis extends along and through the three zones. The ridges and valleys extend along a respective continuous line, which is at least partly curved and forms an angle of inclination with the longitudinal center axis. The
(Continued)

angle of inclination at the longitudinal center axis is less steep for the continuous lines at the first end zone than at the central main zone.

14 Claims, 3 Drawing Sheets

(51) Int. Cl.
*F28F 3/04* (2006.01)
*F28F 13/14* (2006.01)
*F28F 3/08* (2006.01)

(52) U.S. Cl.
CPC ..... *F28F 3/046* (2013.01); *F28F 13/14* (2013.01); *F28F 3/08* (2013.01)

(56) References Cited

U.S. PATENT DOCUMENTS

| | | | | |
|---|---|---|---|---|
| 5,525,311 | A | 6/1996 | Girod et al. | |
| 6,702,005 | B1 | 3/2004 | Blomgren | |
| 7,013,963 | B2 | 3/2006 | Laine et al. | |
| 9,557,119 | B2 * | 1/2017 | Birmingham | F28D 19/044 |
| 2001/0054501 | A1 | 12/2001 | Wehrmann et al. | |
| 2005/0039896 | A1 * | 2/2005 | Laine | F28D 9/0012 165/157 |
| 2011/0139419 | A1 * | 6/2011 | Blomgren | F28F 3/08 165/170 |
| 2015/0179287 | A1 | 6/2015 | Castanie et al. | |
| 2015/0247682 | A1 | 9/2015 | Nilsson et al. | |
| 2016/0313066 | A1 | 10/2016 | Andersson | |

FOREIGN PATENT DOCUMENTS

| | | | |
|---|---|---|---|
| EP | 0 321 480 | B1 | 11/1990 |
| EP | 0 636 239 | B1 | 12/1999 |
| EP | 1 456 591 | B1 | 4/2007 |
| EP | 2 394 129 | B1 | 10/2014 |
| GB | 464004 | A | 4/1937 |
| GB | 2510738 | A | 8/2014 |
| JP | 08271173 | A | 10/1996 |
| JP | 2002-081883 | A | 3/2002 |
| JP | 3654949 | B2 | 6/2005 |
| JP | 2010-145005 | A | 7/2010 |
| WO | 94/19657 | A1 | 9/1994 |
| WO | 2013/076751 | A1 | 5/2013 |
| WO | 2014/067758 | A1 | 5/2014 |
| WO | 2015/082348 | A1 | 6/2015 |
| WO | 2015/086343 | A1 | 6/2015 |

OTHER PUBLICATIONS

Written Opinion (PCT/ISA/237) dated Apr. 19, 2017, by the European Patent Office as the International Searching Authority for International Application No. PCT/EP2017/051715.

Office Action and Search Report (First Office Action) dated Jun. 10, 2019, by the State Intellectual Property Office of the People's Republic of China in corresponding Chinese Patent Application No. 201780013085.9 and an English Translation of the Office Action. (12 pages).

An English Translation of the Office Action (Notice of Reasons for Rejection) dated Aug. 19, 2019, by the Japanese Patent Office in corresponding Japanese Patent Application No. 218-541114. (7 pages).

An English Translation of the Office Action (Notice of Preliminary Rejection) dated Sep. 26, 2019, by the Korean Intellectual Property Office in corresponding Korean Patent Application No. 10-2018-7027144. (4 pages).

Office Action dated Jun. 20, 2019, by the Canadian Intellectual Property Office in corresponding Canadian Patent Application No. 3,009,882. (4 pages).

* cited by examiner

HEAT EXCHANGER PLATE FOR A PLATE HEAT EXCHANGER, AND A PLATE HEAT EXCHANGER

The present invention refers to a heat exchanger plate for a plate heat exchanger for heat exchange between at least a first fluid and a second fluid, the heat exchanger plate comprising a heat exchanger area comprising a first end zone, a central main zone adjoining the first end zone, a second end zone adjoining the central main zone, and a corrugation of ridges and valleys, which extends on the first end zone, the central main zone and the second end zone, and a longitudinal center axis, which extends along and through the first end zone, the central main zone and the second end zone, wherein the ridges and valleys extend along a respective continuous line.

The invention also refers to a plate heat exchanger comprising a plurality of heat exchanger plates. The plate heat exchanger may be a plate heat exchanger for any kind of fluids. In particular, the plate heat exchanger may be an evaporator or a condenser.

In plate heat exchangers, it is important to ensure that the fluid that enters the plate interspaces of the plate heat exchanger is distributed in an efficient manner over the whole heat exchanger area. In particularly, a distribution of the fluid towards the long side edges of the heat exchanger area is essential in order to enable the use of the whole heat exchanger area.

In order to achieve such a proper distribution of the fluid entering the plate interspaces, it is known to provide at least one of the end zones, on which two portholes are located, with a corrugation of ridges and valleys which has a less steep angle of inclination in relation to the longitudinal center axis. Such an angle of inclination will force the fluid outwards towards the long side edges.

However, such a less steep inclination of the corrugation on the end zone is disadvantageous in that the flow of the fluid is disturbed in the transition from the end zone to the central main zone, which has a more steep inclination of the corrugation for a more optimized heat transfer.

WO 2015/082348 discloses a plate heat exchanger without straight flow channels for exchanging heat between fluids. The heat exchanger comprises a number of heat exchanger plates provided with a pressed pattern of ridges and grooves with a pitch. The heat exchanger plates are kept at a distance from each other by contact between ridges and grooves of neighboring plates in contact point. The contact points are positioned so that no straight lines are formed along the length of the heat exchanger plates.

U.S. Pat. No. 7,013,963 discloses a circular plate heat exchanger with heat exchanger plates having ridges and grooves extending along evolvent graphs.

U.S. Pat. No. 2,777,674 discloses a plate heat exchanger with rectangular heat exchange plates having two portholes at the respective end zones of the heat exchanger plates. A corrugation of ridges and valley is provided on a central zone. The ridges and valleys extend a respective continuous curved line.

SUMMARY OF THE INVENTION

The object of the present invention is to overcome the problems discussed above, and to provide an improved flow of the fluid through a plate interspace in a plate heat exchanger, and an improved distribution of the fluid in the plate interspace over substantially the whole heat exchanger area.

This object is achieved by the heat exchanger plate initially defined, which is characterized in that the continuous line is curved, or at least partly curved, and forms an angle of inclination with the longitudinal center axis, and that the angle of inclination at the longitudinal center axis is less steep for each, or substantially each, of the continuous lines at the first end zone than at the central main zone.

With such a heat exchanger plate, it is possible to change the inclination of the corrugation from a less steep inclination relative to the longitudinal center axis at the first end zone to a more steep inclination at the central main zone. This change of the inclination may be continuous, and thus all abrupt changes of the inclination may be avoided. The first fluid is thus permitted to flow smoothly from the first end zone to the central main zone.

The less steep inclination at the first end zone, ensures a proper distribution of the first fluid over the whole width of the heat exchanger area. The flow resistance will be relatively great at the first end zone, which will force the first fluid outwards towards the long side edges of the heat exchanger area.

The more steep inclination at the central main zone may ensure an optimum or maintained heat transfer at the central main zone. The flow resistance at the central main zone may be smaller than the flow resistance at the first end zone. A continuous decrease of the flow resistance from the first end zone to the central main zone may be achieved.

The ridges and valleys are thus inclined in relation to the longitudinal center axis. The ridges and valleys may, at least on the central main zone, cross the longitudinal center axis.

Since the ridges and valleys extend along a respective continuous line, there will be no abrupt changes of the direction of the ridges and the valleys. The so called arrow pattern, which in the prior art has caused disturbances or bypasses at the longitudinal center axis, may be avoided.

The continuous and curved extension of the ridges and valleys also contributes to an improved strength of the heat exchanger plate.

According to an embodiment of the invention, the angle of inclination at any longitudinal line extending on the heat exchanger area in parallel with the longitudinal center axis is less steep for each continuous line at the first end zone at said any longitudinal line than for each continuous line at the central main zone at said any longitudinal line.

According to an embodiment of the invention, the heat exchanger area has a first long side edge and a second long side edge, wherein the ridges and valleys of at least the central main zone extends from the first long side edge to the second long side edge.

According to an embodiment of the invention, the heat exchanger area has a first short side edge, delimiting the first end zone and a second short side edge delimiting the second end zone.

According to an embodiment of the invention, the heat exchanger plate comprises two portholes located on the first end zone, and two portholes located on the second end zone. The longitudinal center axis may extend between the two portholes on the first end zone, and between the two portholes on the second end zone.

One of the portholes at the first end zone may be comprised by an inlet for the first fluid, and the other of the portholes at the first end zone may be comprised by an outlet for the second fluid.

In a corresponding manner, one of the portholes at the second end zone may be comprised by an inlet for the second fluid, and the other of the portholes at the second end zone may be comprised by an outlet for the first fluid.

According to an embodiment of the invention, the distance between adjacent ridges, or the peaks of the ridges, is equal on the heat exchanger area. It follows that also the distance between adjacent valleys may be equal on the heat exchanger area. This equidistant positioning of the ridges, and the valleys, is also advantageous and contributes to a uniform distribution of contact points between the ridges of the heat exchanger plate and the valleys of an adjacent heat exchanger plate in the plate heat exchanger. In the same way, the equidistant positioning of the ridges, and the valleys, contributes to a uniform distribution of contact points between the valleys of the heat exchanger plate and the ridges of an adjacent heat exchanger plate in the plate heat exchanger.

According to an embodiment of the invention, the heat exchanger plate comprises an outer edge area surrounding the heat exchanger area. The outer edge area may form a flange being inclined in relation to an extension plane of the heat exchanger area. Such a flange may adjoin a corresponding flange of an adjacent heat exchanger plate in the plate heat exchanger.

According to an embodiment of the invention, the continuous lines have at least one elliptic or oval extension, in particular at least one circular extension. The continuous lines thus may be a part of an ellipse, a circle or an oval ring.

According to an embodiment of the invention, the continuous lines have at least one common center point located outside the heat exchanger area. In the case that the continuous lines have an elliptic extension, they have two common center points outside the heat exchanger area.

According to an embodiment of the invention, the angle of inclination is less steep for each, or substantially each, of the continuous lines at the second end zone than at the central main zone. This embodiment provides the same advantages for the second fluid flowing from the second end zone to the central main zone as for the first fluid flowing from the first end zone to the central main zone.

According to an embodiment of the invention, the heat exchanger plate comprises

- a first half comprising the first end zone and a first part of the central main zone, and
- a second half comprising the second end zone and a second part of the central main zone,
- wherein the first half and the second half adjoin each other along a dividing line.

According to an embodiment of the invention, the continuous lines on the first half extend with an elliptic extension, in particular a circular extension, and continue on the second half with an elliptic extension, in particular a circular extension.

According to an embodiment of the invention, the continuous lines on the first half have a first common center point, or at least one first common center point, located outside a first side of the heat exchanger area, and the continuous lines on the second half have a second common center point, or at least one second common center point, located outside a second side of the heat exchanger area.

According to an embodiment of the invention, the continuous lines at the dividing line extend perpendicularly to the dividing line.

The object is also achieved by the plate heat exchanger initially defined, which comprises a plurality of heat exchanger plates as according to the various embodiments explained above.

According to an embodiment of the invention, the heat exchanger plates comprises first heat exchanger plates and second heat exchanger plates arranged in an alternating order in the plate heat exchanger, wherein the angle of inclination of the first heat exchanger plates is equal to but with reversed sign in comparison with the angle of inclination of the second heat exchanger plates.

BRIEF DESCRIPTION OF THE DRAWINGS

The present invention is now to be explained more closely through a description of various embodiments and with reference to the drawings attached hereto.

DETAILED DESCRIPTION OF VAIOUS EMBODIMENT

Figure 1:
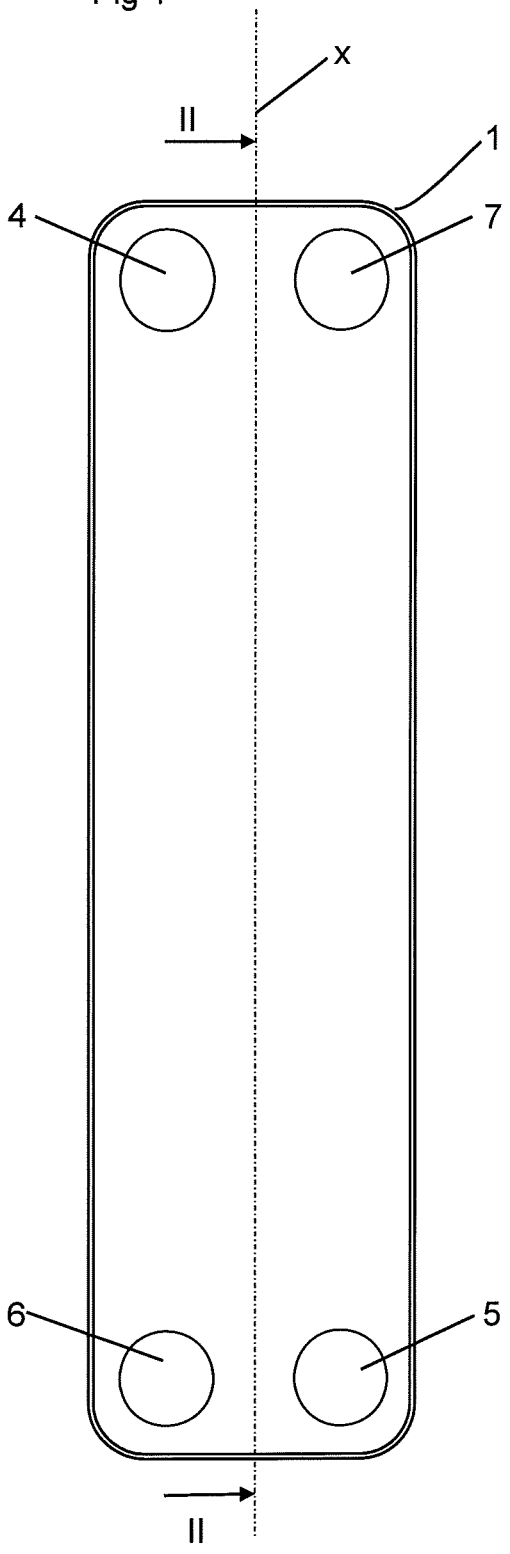
FIG. 1 discloses schematically a plan view of a plate heat exchanger according to a first embodiment of the invention FIG. 2 discloses schematically a longitudinal sectional view along the line II-II in FIG. 1
Figure 2:
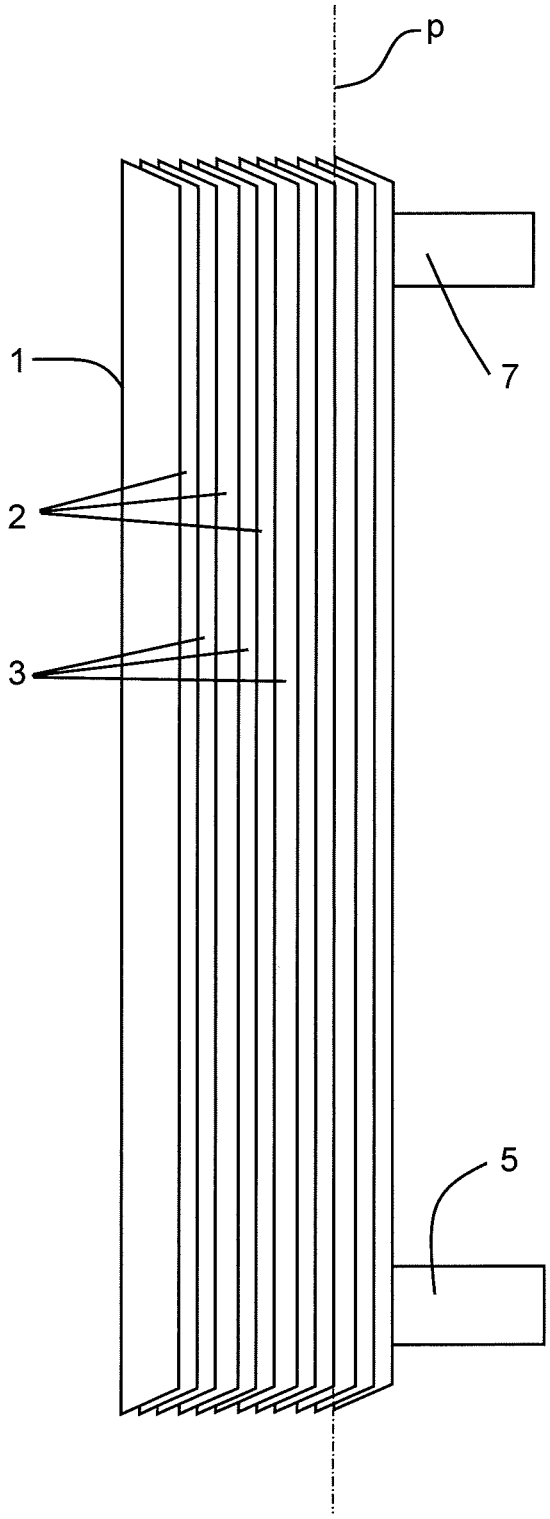

FIGS. 1 and 2 discloses a plate heat exchanger comprising a plurality of heat exchanger plates 1. The heat exchanger plates 1 are provided beside each other to form first plate interspaces 2 and second plate interspaces 3 in the plate heat exchanger. The first and second plate interspaces 2 and 3 are provided in an alternating order in the plate heat exchanger.

The plate heat exchanger comprises a first inlet 4 and a first outlet 5 for a first fluid. The plate heat exchanger also comprises a second inlet 6 and a second outlet 7 for a second fluid. The first fluid passes through the first plate interspaces 2 and the second fluid passes through the second plate interspaces 3.

It may be noted that the plate heat exchanger may also be configured for more than two fluids, for instance three fluids, wherein the fluids pass respective plate interspace. In this case, the plate heat exchanger may comprise also a third inlet and a third outlet.

A longitudinal center axis x extends along the plate heat exchanger, and along each heat exchanger plate 1.

In the plate heat exchanger disclosed, the heat exchanger plates 1 are permanently joined to each other through any suitable joining technique, for instance brazing, welding, gluing, etc.

It may be noted, however, that the plate heat exchanger also may comprise heat exchanger plates 1, which are kept together by means of tie bolts (not disclosed in the drawings), wherein gaskets (not disclosed in the drawings) are provided between the heat exchanger plates 1 to seal the first and second plate interspaces 2 and 3 from each other and from the surrounding environment.

Figures 3, 4:
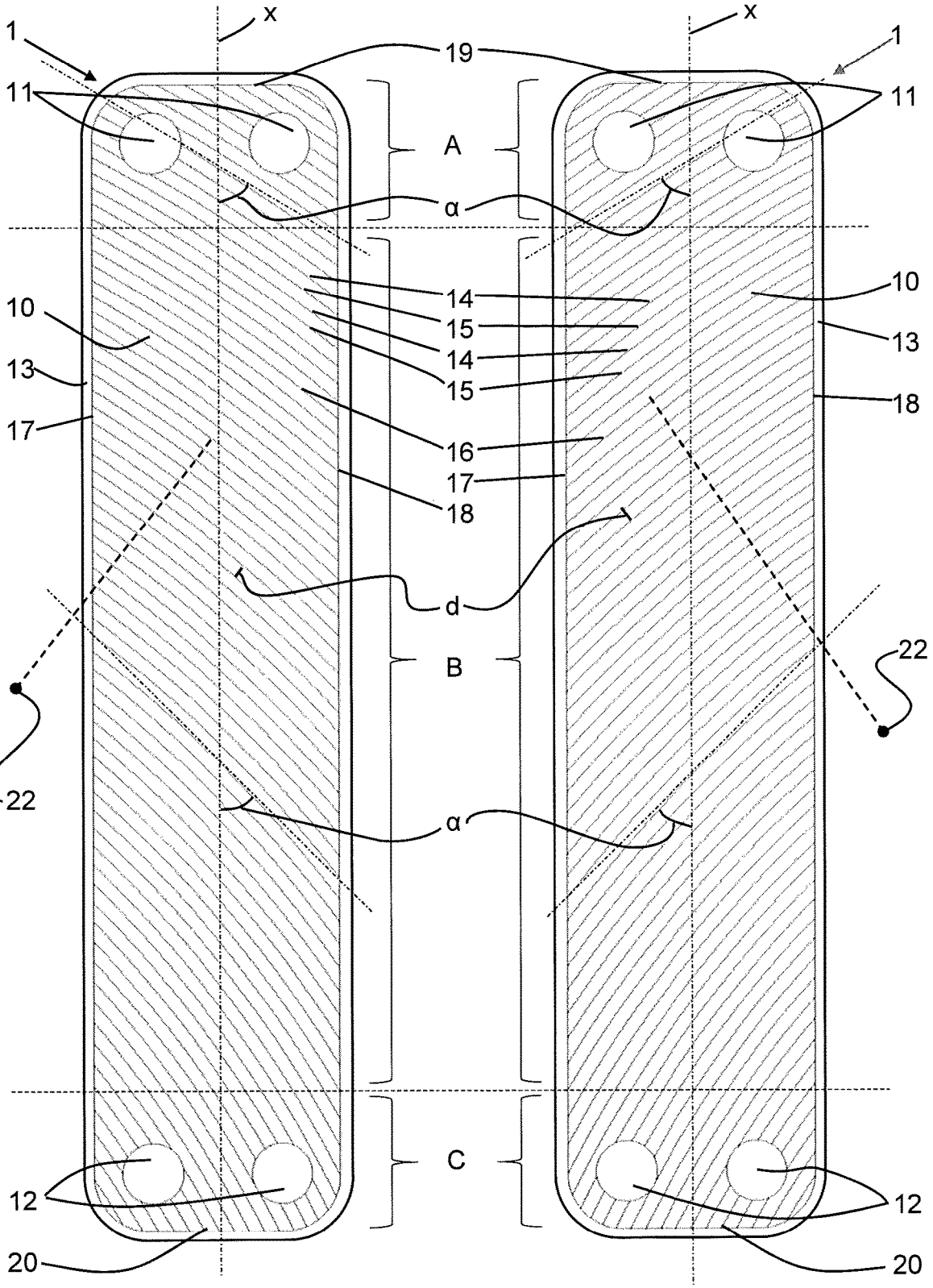
FIG. 3 discloses schematically a plan view of a heat exchanger plate of the plate heat exchanger in FIG. 1
FIG. 4 discloses schematically a plan view of another heat exchanger plate of the plate heat exchanger in FIG. 1

FIG. 3 discloses one of the heat exchanger plates 1 of the plate heat exchanger. The heat exchanger plate 1 has a rectangular, or generally rectangular, shape with rounded corners, and extends in parallel with an extension plane p, see FIG. 2.

The heat exchanger plate 1 comprises a heat exchanger area 10 which comprises a first end zone A, a central main zone B, which adjoins the first end zone A, and a second end zone C, which adjoins the central main zone B.

The longitudinal center axis x extends along and though the first end zone A, the central main zone B and the second end zone C. The heat exchanger plate 1 comprises two portholes 11 provided on the first end zone A on a respective side of the longitudinal center axis x, and two portholes 12 provided on the second end zone C on a respective side of the longitudinal center axis x.

In case of three fluids, as mentioned above, the heat exchanger plate 1, may comprise three portholes 11 on the first end zone A, and three portholes 12 on the second end zone C.

The two portholes 11 on the first end zone A may be comprised by the first inlet 4 and the second outlet 7. The two portholes 12 on the second end zone C may be comprised by the first outlet 5 and the second inlet 6.

The heat exchanger plate 1 also comprises an outer edge area 13 surrounding the heat exchanger area 10, i.e. the first end zone A, the central main zone B and the second end zone C.

In the plate heat exchanger disclosed, the outer edge area 13 form a flange which is inclined in relation to the extension plane p of the heat exchanger area 10, see FIG. 2. The flange of the outer edge area 13 of the heat exchanger plate 1 adjoins, and may be joined to, a corresponding flange of an outer edge area 13 of an adjacent heat exchanger plate 1 in the plate heat exchanger.

The heat exchanger area 10 comprises a corrugation of ridges 14 and valleys 15. The corrugation extends on the first end zone A, the central main zone B and the second end zone C.

The ridges 14 and valleys 15 extend along a respective continuous line 16, which is curved, or continuously curved, and forms an angle α of inclination with the longitudinal center axis x. The continuous lines 16 extends along the peak of the ridges 14 and the valleys 15.

In the first embodiment, the continuous lines 16 are curved along their whole length on the heat exchanger area 10.

The heat exchanger area 10 has a first long side edge 17, a second long side edge 18, a first short side edge 19 and a second short side edge 20. The ridges 13 and valleys 14 of at least the central main zone B extends from the first long side edge 17 to the second long side edge 18. The first short side edge 19, delimits the first end zone A. The second short side edge 20 delimits the second end zone C.

The distance d between adjacent ridges 14, or the peak of adjacent ridges 14, is equal on the heat exchanger area 10, or the whole heat exchanger area 10. It follows that the distance d is the same between the adjacent valleys 15 on the heat exchanger area 10, and for the continuous lines 16.

As can be seen in FIG. 3, the angle α of inclination at the longitudinal center axis x is less steep for the continuous lines 16 at the first end zone A than for the continuous lines 16 at the central main zone B.

This is also valid for any longitudinal line 21 extending of the heat exchanger area 10 in parallel with the longitudinal center axis x. Consequently, the angle α of inclination at said any longitudinal line 21 is less steep for each continuous line 16 at the first end zone A at said any longitudinal line 21 than for each continuous line 16 at the central main zone B at said any longitudinal line 21.

In the first embodiment, the continuous lines 16 have a circular extension, i.e. they form a part of a circle. All the continuous lines 16 on the heat exchanger area 10 have a common center point 22 located outside the heat exchanger area 10, and in FIG. 3 to the left of the longitudinal center axis x.

FIG. 4 discloses another heat exchanger plate 1 to be included in the plate heat exchanger shown in FIGS. 1 and 2. The heat exchanger plate 1 in FIG. 4 is identical to the heat exchanger plate 1 in FIG. 3 but the heat exchanger area is turned 180° so that the continuous lines 16 will have their common center point 22 located outside the heat exchanger area 10 to the right of the longitudinal center axis x.

In other words, the heat exchanger plates 1 of the plate heat exchanger comprises first heat exchanger plates 1, shown in FIG. 3, and second heat exchanger plates 1, shown in FIG. 4. The first and second heat exchanger plates 1 are arranged in an alternating order in the plate heat exchanger. As can be seen in FIGS. 3 and 4, the angle α of inclination of the first heat exchanger plates 1 is equal to but with reversed sign in comparison with the angle α of inclination of the second heat exchanger plates 1.

It is to be noted that the common center points 22 are only schematically indicated and in reality they will be more far from the heat exchanger plates 1 than shown in FIGS. 3 and 4.

Figures 5, 6:
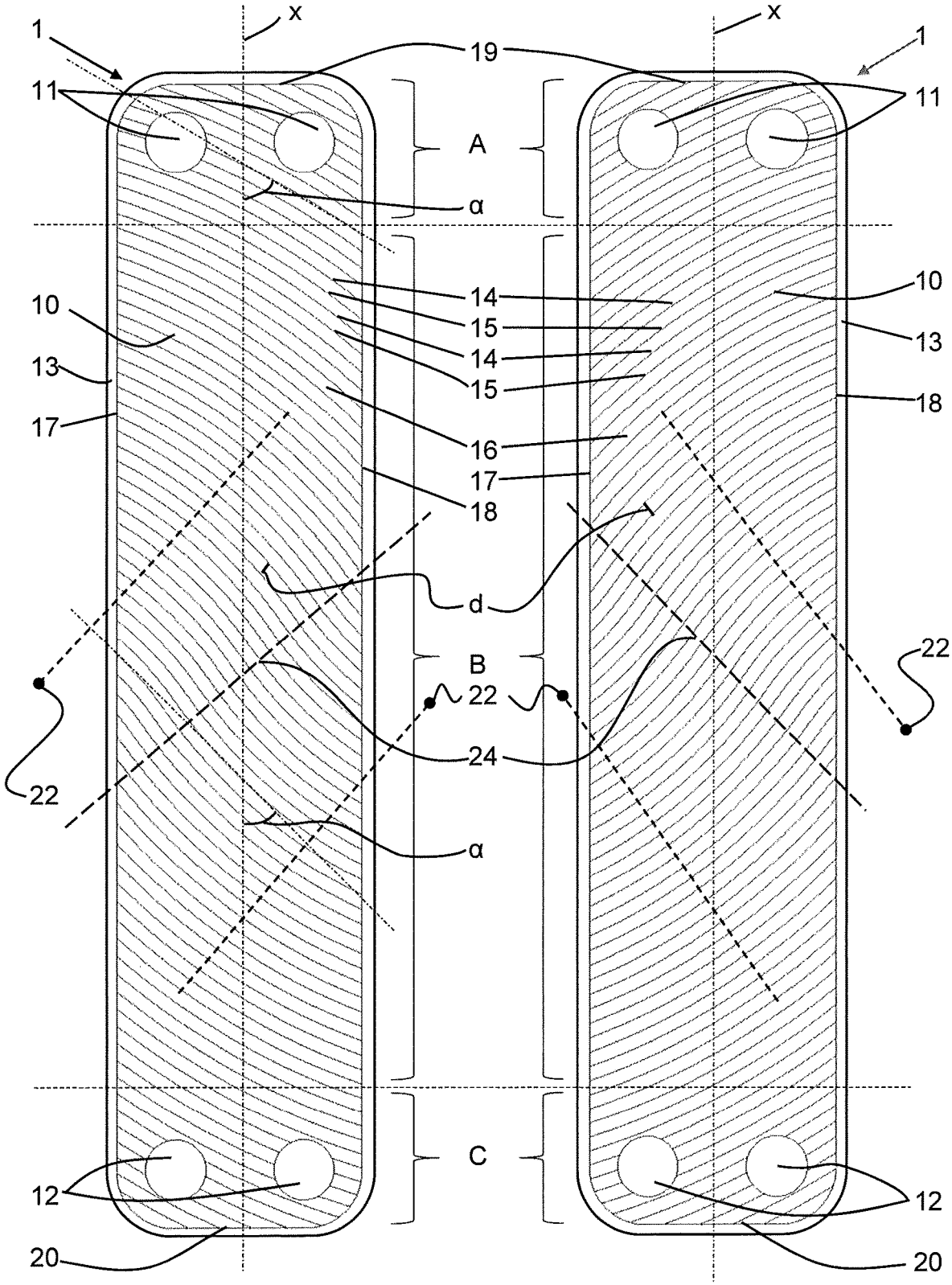
FIG. 5 discloses schematically a plan view of a heat exchanger plate for a plate heat exchanger according to a second embodiment FIG. 6 discloses schematically another heat exchanger plate for the plate heat exchanger according to the second embodiment.

FIGS. 5 and 6 disclose two heat exchanger plates 1 according to a second embodiment, which differs from the first embodiment of the heat exchanger plates 1 in that the angle α of inclination is less steep also at the second end zone C than at the central main zone B.

The continuous lines 16 will have a circular extension on a first half of the heat exchanger area 10 and another circular extension on a second half of the heat exchanger area 10. The first half comprises the first end zone A and a first part of the central main zone B. The second half comprising the second end zone C and a second part of the central main zone B.

The first and second halves are adjoining each other along a dividing line 24. At the dividing line 24, the continuous lines 16 extend continuously across the dividing line 24. Each of the continuous lines 16 is perpendicular, or substantially perpendicular, to the dividing line 24 when crossing the dividing line 24. The dividing line 24 is inclined in relation to the longitudinal center axis x as can be seen in FIGS. 5 and 6. The angle of inclination of the dividing line 24 may be 45° in relation to the longitudinal center axis x.

The continuous lines 16 on the first half of the heat exchanger plate 1 in FIG. 5 have a circular extension with a common center point 22 located outside the heat exchanger area 10, and in FIG. 5 to the left of the longitudinal center axis x. The continuous lines 16 on the second half of the heat exchanger plate 1 in FIG. 5 have a circular extension with a common center point 22 located outside the heat exchanger area 10, and in FIG. 5 to the right of the longitudinal center axis x. Also in this case, it is to be noted that the common center points 22 are only schematically indicated and in reality they will be located more far from the heat exchanger plates 1 than shown in the figures.

Also in the second embodiment, the heat exchanger plates 1 of the plate heat exchanger comprises first heat exchanger plates 1, shown in FIG. 5, and second heat exchanger plates 1, shown in FIG. 6, wherein the first and second heat exchanger plates 1 are arranged in an alternating order in the plate heat exchanger. Also FIGS. 5 and 6 illustrate that the angle α of inclination of the first heat exchanger plates 1 is equal to but with reversed sign in comparison with the angle α of inclination of the second heat exchanger plates 1.

The invention is not limited to the embodiments disclosed but may be varied and modified within the scope of the following claims.

The invention claimed is:

1. A heat exchanger plate for a plate heat exchanger for heat exchange between at least a first fluid and a second fluid, the heat exchanger plate comprising:

a heat exchanger area comprising:

a first end zone, a central main zone adjoining the first end zone, a second end zone adjoining the central main zone, and a corrugation of ridges and valleys, which extends on the first end zone, the central main zone and the second end zone, and a longitudinal center axis, which extends along and through the first end zone, the central main zone and the second end zone, wherein each ridge and valley extends along a respective continuous line, the continuous lines being at least partly curved and forming an angle of inclination with the longitudinal center axis, and the angle of inclination at the longitudinal center axis being less steep for substantially each of the continuous lines at the first end zone than at the central main zone, wherein the heat exchanger plate comprises two portholes located on the first end zone, and two portholes located on the second end zone.

2. A heat exchanger plate according to claim 1, wherein the angle of inclination at any longitudinal line extending on the heat exchanger area in parallel with the longitudinal center axis is less steep for each continuous line at the first end zone at said any longitudinal line than for each continuous line at the central main zone at said any longitudinal line.

3. A heat exchanger plate according to claim 1, wherein the heat exchanger area has a first long side edge and a second long side edge, and wherein the ridges and valleys of at least the central main zone extends from the first long side edge to the second long side edge.

4. A heat exchanger plate according to claim 1, wherein the heat exchanger area has a first short side edge, delimiting the first end zone and a second short side edge delimiting the second end zone.

5. A heat exchanger plate according to claim 1, wherein the distance between adjacent ridges is equal on the heat exchanger area.

6. A heat exchanger plate according to claim 1, wherein the heat exchanger plate comprises an outer edge area surrounding the heat exchanger area.

7. A heat exchanger plate according to claim 1, wherein the continuous lines have at least one elliptic or oval extension.

8. A heat exchanger plate according to claim 1, wherein the continuous lines have at least one common center point located outside the heat exchanger area.

9. A heat exchanger plate according to claim 1, wherein the angle of inclination for substantially each of the continuous lines is less steep at the second end zone than at the central main zone.

10. A heat exchanger plate according to claim 9, wherein the heat exchanger plate comprises:

a first half comprising the first end zone and a first part of the central main zone and a second half comprising the second end zone and a second part of the central main zone, wherein the first half and the second half adjoin each other along a dividing line.

11. A heat exchanger plate according to claim 10, wherein the continuous lines on the first half have an elliptic extension, in particular a circular extension, and wherein the continuous lines on the second half have an elliptic extension, in particular a circular extension.

12. A heat exchanger plate according to claim 10, wherein the continuous lines at the dividing line extend perpendicularly to the dividing line.

13. A plate heat exchanger comprising a plurality of heat exchanger plates according to claim 1.

14. A plate heat exchanger according to claim 13, wherein the heat exchanger plates comprises first heat exchanger plates and second heat exchanger plates arranged in an alternating order in the plate heat exchanger, and wherein the angle of inclination of the first heat exchanger plates is equal to but with reversed sign in comparison with the angle of inclination of the second heat exchanger plates.

* * * * *